US010724379B2

(12) United States Patent
Murdock

(10) Patent No.: US 10,724,379 B2
(45) Date of Patent: Jul. 28, 2020

(54) LOCALLY EXTENDED LEADING EDGE SHEATH FOR FAN AIRFOIL

(71) Applicant: UNITED TECHNOLOGIES CORPORATION, Farmington, CT (US)

(72) Inventor: James R. Murdock, Tolland, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 703 days.

(21) Appl. No.: 14/767,180

(22) PCT Filed: Dec. 16, 2013

(86) PCT No.: PCT/US2013/075342

§ 371 (c)(1),
(2) Date: Aug. 11, 2015

(87) PCT Pub. No.: WO2014/143262

PCT Pub. Date: Sep. 18, 2014

(65) Prior Publication Data

US 2015/0377030 A1 Dec. 31, 2015

Related U.S. Application Data

(60) Provisional application No. 61/789,550, filed on Mar. 15, 2013, provisional application No. 61/877,394, filed on Sep. 13, 2013.

(51) Int. Cl.

| | |
|---|---|
| ***F01D 5/14*** | (2006.01) |
| ***F04D 29/32*** | (2006.01) |
| ***F01D 5/28*** | (2006.01) |

(52) U.S. Cl.

CPC ..... *F01D 5/147* (2013.01); *F01D 5/28* (2013.01); *F01D 5/288* (2013.01); *F04D 29/324* (2013.01);

(Continued)

(58) Field of Classification Search

CPC ... F01D 5/12; F01D 5/14; F01D 5/141; F01D 5/147; F01D 5/28; F01D 5/288;

(Continued)

(56) References Cited

U.S. PATENT DOCUMENTS

2011/0033308 A1 2/2011 Huth et al.
2011/0182740 A1* 7/2011 Klinetob ..... F01D 5/147 416/224

(Continued)

FOREIGN PATENT DOCUMENTS

FR 2972127 A1 9/2012
JP WO 2012090736 A1 * 7/2012 ..... F01D 5/141

(Continued)

OTHER PUBLICATIONS

International Search Report for Application No. PCT/US2013/075342; dated Apr. 10, 2014.

(Continued)

*Primary Examiner* — Mark A Laurenzi
*Assistant Examiner* — Xiaoting Hu
(74) *Attorney, Agent, or Firm* — Cantor Colburn LLP

(57) ABSTRACT

A sheath, for protecting the leading edge of airfoils used in gas turbine engines, may have a solid member, a pressure side flank and a suction side flank. The solid member may form an outer edge, which may include a main portion and a projecting portion. The projecting portion may have a variable dimension. The pressure side flank and suction side flank may project from the solid member opposite the outer edge. The pressure side flank and suction side flank may form a receiving cavity for receiving an airfoil.

17 Claims, 3 Drawing Sheets

(52) U.S. Cl.
CPC ..... *F05D 2220/32* (2013.01); *F05D 2220/36* (2013.01); *F05D 2240/303* (2013.01); *F05D 2300/121* (2013.01); *F05D 2300/133* (2013.01)

(58) Field of Classification Search
CPC ..... F05D 2240/303; F05D 2220/32; F05D 2220/36; F04D 29/324; F04D 29/325
See application file for complete search history.

(56) References Cited

U.S. PATENT DOCUMENTS

2011/0194941 A1* 8/2011 Parkin ..... B29C 70/48 416/224
2011/0211967 A1* 9/2011 Deal ..... F01D 5/147 416/224
2011/0229334 A1* 9/2011 Alexander ..... F01D 5/282 416/224
2012/0003100 A1* 1/2012 James ..... F01D 5/282 416/230
2012/0021243 A1* 1/2012 Kray ..... B23P 15/04 428/602
2012/0134839 A1 5/2012 Parkin et al.
2012/0233859 A1 9/2012 Cattiez et al.
2012/0301292 A1 11/2012 Deal et al.
2013/0004322 A1* 1/2013 Schwarz ..... F01D 5/28 416/224
2013/0111908 A1* 5/2013 Murooka ..... F01D 5/28 60/726
2013/0323065 A1* 12/2013 Murooka ..... F01D 5/141 416/219 R
2014/0193271 A1 7/2014 Dudon et al.

FOREIGN PATENT DOCUMENTS

WO 2011064406 A1 6/2011
WO 2013021141 A1 2/2013

OTHER PUBLICATIONS

English Machine Translation for Abstract FR2972127.
European Search Report for Application No. EP 13 87 7960.

* cited by examiner

LOCALLY EXTENDED LEADING EDGE SHEATH FOR FAN AIRFOIL

CROSS-REFERENCE TO RELATED APPLICATIONS

This Application is a US National Stage under 35 USC § 371 of International Patent Application No. PCT/US13/75342 filed on Dec. 16, 2013 based on U.S. Provisional Patent Application Ser. No. 61/877,394, filed on Sep. 13, 2013 and U.S. Provisional Patent Application Ser. No. 61/789,550, filed on Mar. 15, 2013.

TECHNICAL FIELD

The subject matter of the present disclosure relates generally to gas turbine engines and, more particularly, relates to sheaths for airfoils used in gas turbine engines.

BACKGROUND

In efforts to reduce the overall weight of gas turbine engines, lighter-weight materials have been implemented for many different components within the engine. For example, gas turbine engine fan blades have been manufactured from titanium, but in more recent designs, fan blades are manufactured from aluminum or composite materials. The aluminum or composite fan blades do not share the same impact strength properties of titanium fan blades. As such, the aluminum or composite fan blades are typically equipped with a protective sheath along their leading edge to improve impact strength and prevent blade damage from foreign object impact, such as impact with birds, hail or other debris, which may lead to catastrophic engine failure or secondary damage downstream of the fan blades. Often times the sheaths are made from titanium or other high strength materials protecting the aluminum or composite fan blades from blade damage such as cracking, delamination, deformation or erosion caused by impacting foreign objects.

Certain portions of the fan blade experience significantly more stress and strain than other portions during foreign object impact. One such portion is the leading edge area adjacent the root of the fan blade. This area is particularly vulnerable during impact because a relatively significant decrease in area thickness begins where the blade transitions to the root region. Increasing the thickness in this area of the fan blade provides a desired strengthening for a more structural blade. This increase will necessarily increase the sheath area for this portion of the fan blade as well. However, because the sheath is in the flowpath, it is desirable to maintain a minimum amount of sheath material along the rest of the fan blade while increasing the amount of sheath material corresponding to the increased area of the fan blade.

Accordingly, there is a need to provide a sheath that accommodates an increased structural thickness of a fan blade area, where the blade transitions to the root region, while maintaining a minimum amount of sheath material that covers the fan blade along the other area of the leading edge.

SUMMARY

In accordance with an aspect of the disclosure, a sheath for an airfoil is provided. The sheath may include a solid member, a pressure side flank and a suction side flank. The solid member may form an outer edge having a main portion and a projecting portion. The projecting portion may include a variable dimension. The suction side flank may project from the solid member opposite the outer edge. Similarly, the pressure side flank may project from the solid member opposite the outer edge. The pressure side flank and the suction side flank may form a receiving cavity for receiving the airfoil.

In accordance with another aspect of the disclosure, the main portion may include a uniform dimension, as measured from the outer edge of the solid member to a flank edge of the pressure side flank, which may be uniform in dimension taken along a span-wise direction.

In accordance with yet another aspect of the disclosure, the variable dimension of the projecting portion, as measured from the outer edge of the solid member to a flank edge of the pressure side flank, may vary in dimension taken along a span-wise direction.

In accordance with still yet another aspect of the disclosure, the pressure side flank may include a dimension which covers a minimum section of a pressure surface side of the airfoil.

In further accordance with another aspect of the disclosure, the suction side flank may include a dimension which covers a minimum section of a suction surface side of the airfoil.

In further accordance with yet another aspect of the disclosure, the projecting portion may be adjacent to the uniform portion so that the variable dimension gradually increases as measured along the span-wise direction moving away from the uniform portion.

In accordance with another aspect of the disclosure, an airfoil for a gas turbine engine is provided. The airfoil may include a leading edge, a pressure surface side and a suction surface side. A sheath may be secured to the airfoil. The sheath may include a solid member, a pressure side flank and a suction side flank. The solid member may form an outer edge so that the outer edge may include a main portion and a projecting portion. The projecting portion may have a variable dimension. The pressure side flank may project from the solid member opposite the outer edge and may be secured to the pressure surface side. The suction side flank may project from the solid member opposite the outer edge and may be secured to the suction surface side. The pressure side flank and the suction side flank may form a receiving cavity for receiving the leading edge.

In accordance with yet another aspect of the disclosure, the pressure side flank may be secured to the pressure surface side by an epoxy adhesive and the suction side flank may be secured to the suction side by an epoxy adhesive.

In accordance with still another aspect of the disclosure, the airfoil may be manufactured from aluminum.

In accordance with still yet another aspect of the disclosure, the sheath may be manufactured from titanium.

In accordance with another aspect of the disclosure, a method of protecting a leading edge of an airfoil is provided. The method entails forming a sheath to include a solid member, an outer edge with a projecting portion and a main portion, a pressure side flank, and a suction side flank. The projecting portion formed adjacent to the main portion. The projecting portion formed may have a variable dimension. Another step may include securing the sheath to the airfoil, which may have a tip, a root, a pressure surface side, a suction surface side, and a trailing edge. The sheath may be secured to the airfoil so that the pressure side flank may be secured to the pressure surface side of the airfoil and the suction side flank may be secured to the suction surface side of the airfoil.

In accordance with yet another aspect of the disclosure, forming the sheath may include forming the projecting portion so that the variable dimension gradually increases as measured along a span-wise direction moving away from the main portion.

In accordance with still another aspect of the disclosure, forming the sheath may include forming the pressure side flank so that a dimension of the pressure side flank covers a minimum section of the pressure surface side of the airfoil.

In accordance with still yet another aspect of the disclosure, forming the sheath may include forming the suction side flank so that a dimension of the suction side flank covers a minimum section of the suction surface side of the airfoil.

In further accordance with another aspect of the disclosure, forming the sheath may include forming the main portion so that the main portion may have a uniform dimension that is uniform as measured along a span-wise direction moving away from the projecting portion.

Other aspects and features of the disclosed systems and methods will be appreciated from reading the attached detailed description in conjunction with the included drawing figures. Moreover, selected aspects and features of one example embodiment may be combined with various selected aspects and features of other example embodiments.

BRIEF DESCRIPTION OF THE DRAWINGS

For further understanding of the disclosed concepts and embodiments, reference may be made to the following detailed description, read in connection with the drawings, wherein like elements are numbered alike, and in which.

It is to be noted that the appended drawings illustrate only typical embodiments and are therefore not to be considered limiting with respect to the scope of the disclosure or claims. Rather, the concepts of the present disclosure may apply within other equally effective embodiments. Moreover, the drawings are not necessarily to scale, emphasis generally being placed upon illustrating the principles of certain embodiments.

DETAILED DESCRIPTION

Figure 1:
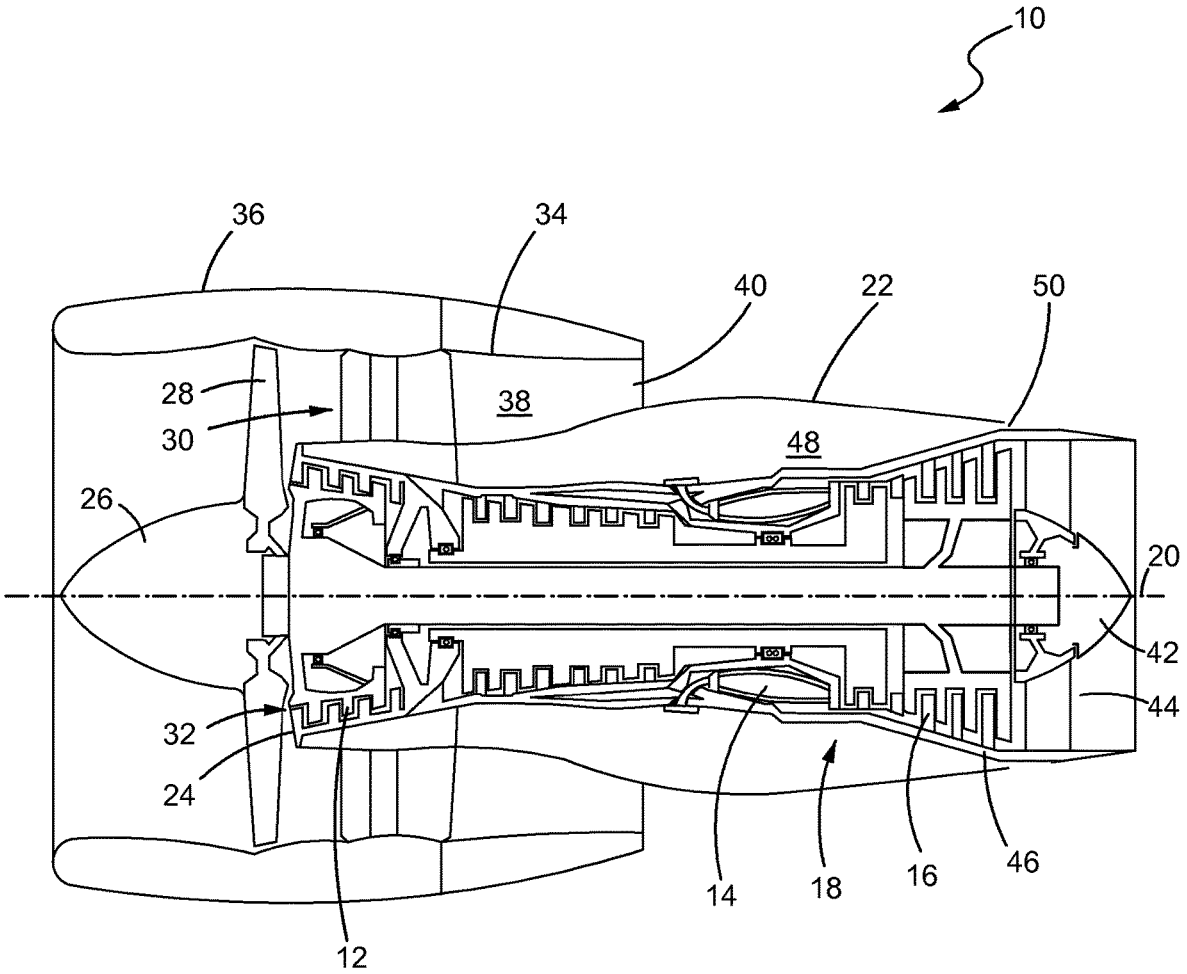
FIG. 1 is a schematic side view of a gas turbine engine with portions of the nacelle thereof sectioned and broken away to show details of the present disclosure.
Figure 2:
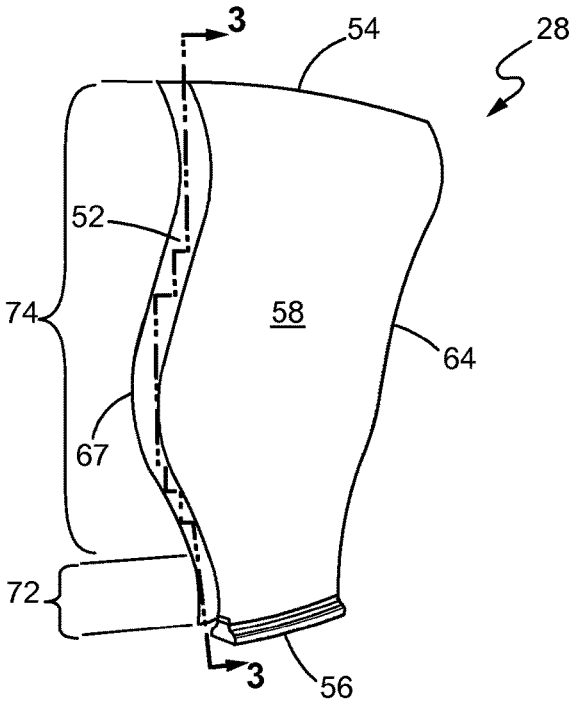
FIG. 2 is a perspective side view of an airfoil, constructed in accordance with the teachings of this disclosure.

Referring now to FIG. 1, a gas turbine engine constructed in accordance with the present disclosure is generally referred to by reference numeral 10. The gas turbine engine 10 includes a compressor 12, a combustor 14 and a turbine 16. The serial combination of the compressor 12, the combustor 14 and the turbine 16 is commonly referred to as a core engine 18. The core engine 18 lies along a longitudinal central axis 20. A core engine cowl 22 surrounds the core engine 18.

As is well known in the art, air enters compressor 12 at an inlet 24 and is pressurized. The pressurized air then enters the combustor 14. In the combustor 14, the air mixes with jet fuel and is burned, generating hot combustion gases that flow downstream to the turbine 16. The turbine 16 extracts energy from the hot combustion gases to drive the compressor 12 and a fan 26, which has airfoils 28. As the turbine 16 drives the fan 26, the airfoils 28 rotate so as to take in more ambient air. This process accelerates the ambient air 30 to provide the majority of the useful thrust produced by the engine 10. Generally, in modern gas turbine engines, the fan 26 has a much greater diameter than the core engine 18. Because of this, the ambient air flow 30 through the fan 26 can be 5-10 times higher, or more, than the combustion air flow 32 through the core engine 18. The ratio of flow through the fan 26 relative to flow through the core engine 18 is known as the bypass ratio.

The fan 26 and core engine cowl 22 are surrounded by a fan cowl 34 forming part of a nacelle 36. A fan duct 38 is functionally defined by the area between the core engine cowl 22 and the fan cowl 34. The fan duct 38 is substantially annular in shape so that it can accommodate the air flow produced by the fan 26. This air flow travels the length of the fan duct 38 and exits downstream at a fan nozzle 40. A tail cone 42 may be provided at the core engine exhaust nozzle 44 to smooth the discharge of excess hot combustion gases that were not used by the turbine 16 to drive the compressor 12 and fan 26. The core engine exhaust nozzle 44 is the annular area located between the tail cone 42 and a core engine case 46, which surrounds the core engine 18. The core engine case 46, as such, is surrounded by the core engine cowl 22.

Moreover, the core engine cowl 22 is radially spaced apart from the core engine case 46 so that a core compartment 48 is defined therebetween. The core compartment 48 has an aft vent 50, which is located at the downstream portion of the core compartment 48 and is concentrically adjacent to the core engine exhaust nozzle 44.

FIGS. 2-5 illustrate various views of the airfoil 28 with a sheath 52. As depicted in the figures, the airfoil 28 may include a tip 54, a root 56, a pressure surface side 58, a suction surface side 60, a leading edge 62 and a trailing edge 64. The sheath 52 may include a solid member 66, an outer edge 67, a pressure side flank 68, and a suction side flank 70. The solid member 66 may taper to form the outer edge 67, which may extend the span of the airfoil between tip 54 and root 56 to protect the leading edge 62 of the airfoil 28 from impact damage and erosion. Opposite the outer edge 67, the flanks 68,70 project from the solid member 66 in such a way so as to form a receiving cavity 71, which may receive the leading edge 62 of the airfoil 52.

Figure 3:
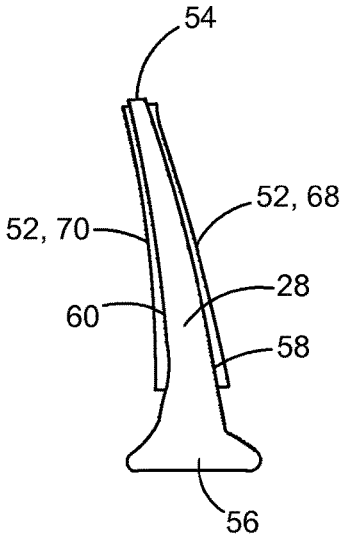
FIG. 3 is a cross-sectional view taken along line A-A of the airfoil of FIG. 2, constructed in accordance with the teachings of this disclosure.
Figure 5:
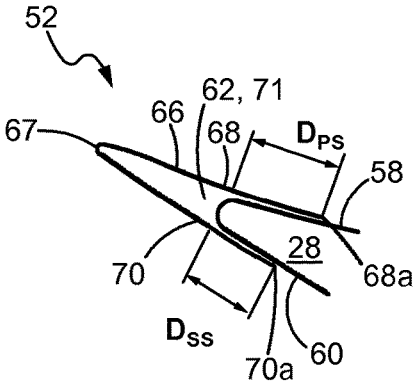
FIG. 5 is a cross-sectional view taken along line B-B of the airfoil of FIG. 4, constructed in accordance with the teachings of this disclosure.

As best seen in FIGS. 3 and 5, the pressure side flank 68 may be secured onto the pressure surface side 58 of the airfoil 28 and the suction side flank 70 may be secured onto the suction surface side 60 of the airfoil 28. Both flanks 68,70 may be secured to the airfoil 28 by an epoxy adhesive. However, other methods of securing the sheath 52 onto the airfoil 28, such as, but not limited to, wielding, mechanical fasteners, and other adhesives, also fit within the scope of the present disclosure. The pressure side flank 68 may extend a minimum dimension $D_{ps}$ onto pressure surface side 58. The minimum dimension $D_{ps}$ may be measured from the flank edge 68*a* of the pressure side flank 68 to the receiving cavity 71 where the leading edge 62 is adjacent when sheath 52 is secured to the airfoil 28. The minimum dimension $D_{ps}$ may be a uniform measurement as taken along a corresponding span-wise direction of the airfoil 28.

In a similar fashion, the suction side flank 70 may extend a minimum dimension $D_{ss}$ onto suction surface side 60. The minimum dimension $D_{ss}$ may be measured from the flank edge 70*a* of the suction side flank 70 to the receiving cavity 71 where the leading edge 62 is adjacent when sheath 52 is secured to the airfoil 28. The minimum dimension $D_{ss}$ may be a uniform measurement as taken along a corresponding span-wise direction of the airfoil 28. As the material of sheath 52 may be denser than the material of airfoil 28, the dimensions $D_{ps}$ and $D_{ss}$ may be designed in consideration of overall engine weight requirements.

The outer edge 67 includes a projecting portion 72 and a main portion 74. The projecting portion 72 may be adjacent to the main portion 74. The projecting portion 72 gradually tapers, moving in a corresponding span-wise direction of the airfoil 28 from root 56 to tip 54, into main portion 74. Prior art airfoils generally are significantly weaker in the area that corresponds to the projecting portion 72 due to a structural thickness that is less than other areas of the airfoil. Current airfoils are manufactured from lighter weight materials than prior art airfoils allowing the area of the airfoil that corresponds to the projecting portion 72 to be increased in structural thickness. Projecting portion 72 is designed to protect this increased portion of the airfoil 28.

Figure 4:
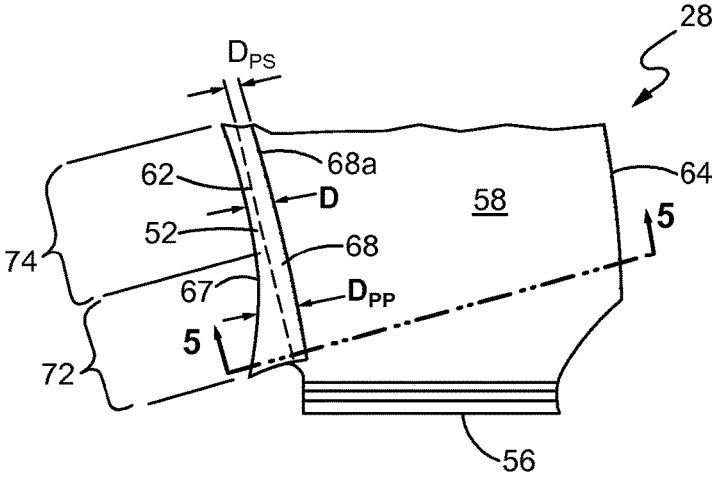
FIG. 4 is a side view of a portion of an airfoil, constructed in accordance with the teachings of this disclosure.

As shown in FIG. 4, main portion 74 may maintain a uniform minimum dimension D, which is measured from the outer edge 67 of the sheath 52 to the flank edge 68*a* of the pressure side flank 68. The uniform minimum dimension D may be a uniform measurement as taken along a span-wise direction moving away from the projecting portion 72. The projecting portion 72, on the other hand, may have a variable dimension $D_{pp}$, which is measured from the outer edge 67 of the sheath 52 to the flank edge 68*a* of the pressure side flank 68. Where the projecting portion 72 is adjacent to the main portion 74, the variable dimension $D_{pp}$ may be approximately equal to the uniform minimum dimension D and may gradually increase as the measurement is taken along the span-wise direction away from the main portion 74.

Figure 6:
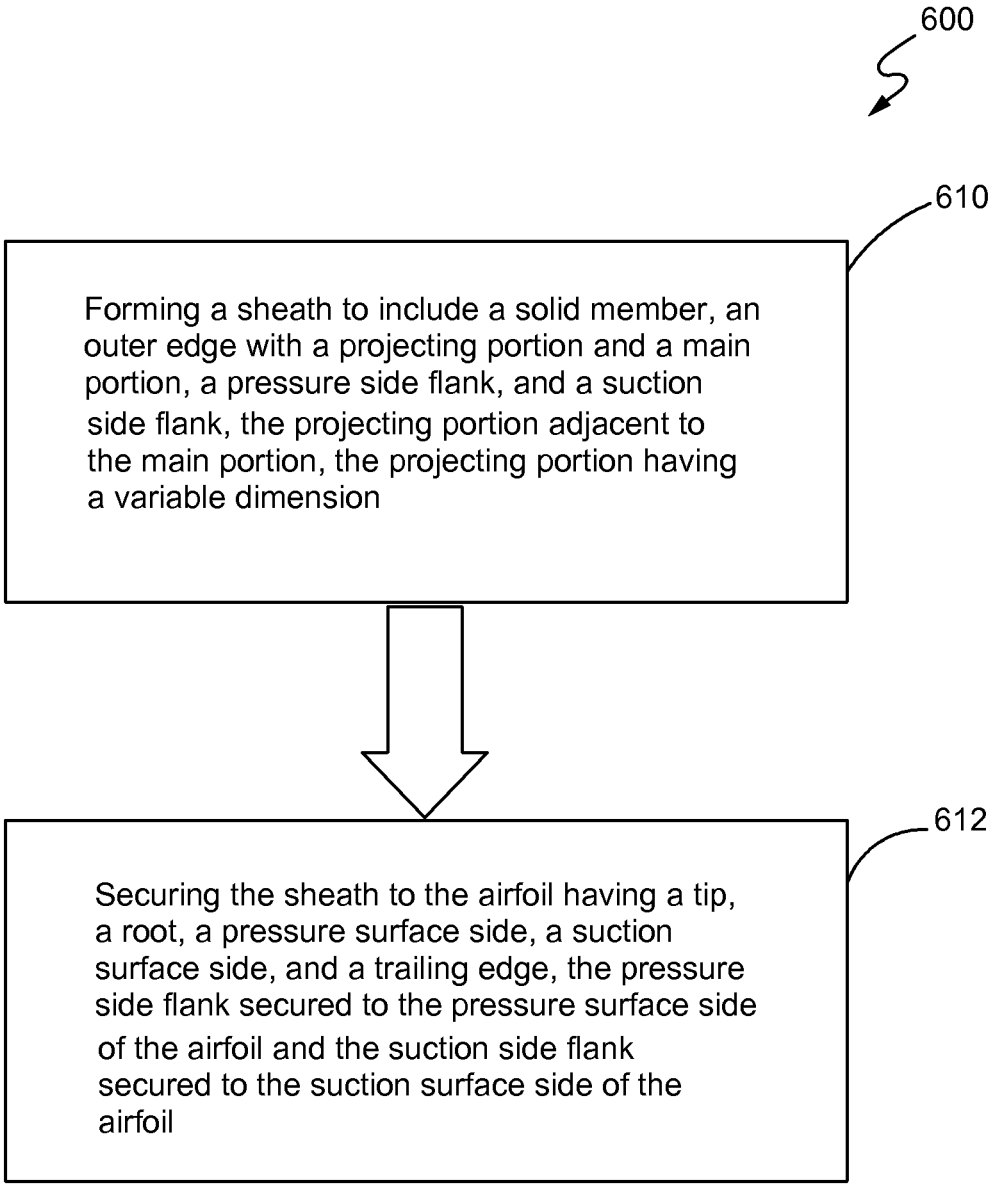
FIG. 6 is a flowchart illustrating the steps of the present disclosure.

FIG. 6 illustrates a flowchart 600 of a method of protecting the leading edge 62 of an airfoil 28. Box 610 shows the step of forming a sheath 52 having a solid member 66, an outer edge 67 with a projecting portion 72 and a main portion 74, a pressure side flank 68, and a suction side flank 70. The outer edge 67 may be formed such that the projecting portion 72 is adjacent to the main portion 74. The dimension $D_{pp}$ of the projecting portion 72 may be formed to gradually increase as measured along a span-wise direction moving away from the main portion 74. On the other hand, the dimension D of the main portion 74 may be formed to have a uniform measurement as measured along a span-wise direction moving away from the projecting portion 72.

Another step, shown in box 612, is to secure the sheath 52 onto the airfoil 28. The airfoil may include a tip 54, a root 56, a pressure surface side 58, a suction surface side 60, a leading edge 62 and a trailing edge 64. The sheath 52 may be secured to the airfoil 28 so that the outer edge 67 of the sheath 52 protects the leading edge 62 of the airfoil 28 between the tip 52 and root 56. Additionally, the sheath 52 may be secured to the airfoil 28 with an epoxy adhesive, as a non-limiting example, so that the pressure side flank 68 may be secured to the pressure surface side 58 and the suction side flank 70 may be secured to the suction surface side 60.

The airfoil 28 may be manufactured from a light-weight material such as, but not limited to, aluminum or composite material. The sheath 52 may be manufactured from a high strength material such as, but not limited to, titanium, titanium alloys, stainless steel, and nickel alloys. The sheath 52 allows for a more structural blade, while preserving the aerodynamic properties of the airfoil. Furthermore, the sheath 52 may be utilized on various types of airfoils such as, but not limited to, fan blades, fan exit vanes, and fan structural guide vanes.

While the present disclosure has shown and described details of exemplary embodiments, it will be understood by one skilled in the art that various changes in detail may be effected therein without departing from the spirit and scope of the disclosure as defined by claims supported by the written description and drawings. Further, where these exemplary embodiments (and other related derivations) are described with reference to a certain number of elements it will be understood that other exemplary embodiments may be practiced utilizing either less than or more than the certain number of elements.

INDUSTRIAL APPLICABILITY

Based on the foregoing, it can be seen that the present disclosure sets forth a locally extended leading edge sheath for an airfoil. The teachings of this disclosure can be employed to allow for a more structurally robust airfoil while still preserving the aerodynamic features of the airfoil. Moreover, through the novel teachings set forth above, the sheath also covers a minimum section of the airfoil to achieve increased engine efficiency while effectively protecting the leading edge of the airfoil from erosion and other damage.

What is claimed is:

1. A sheath for an airfoil, the sheath comprising:

a solid member forming an outer edge, the outer edge including a main portion and a projecting portion, the projecting portion having a variable dimension and extending from the main portion to a distal end of the sheath in a span-wise direction;

a pressure side flank, the pressure side flank projecting from the solid member opposite the outer edge;

a suction side flank, the suction side flank projecting from the solid member opposite the outer edge, the pressure side flank and the suction side flank forming a receiving cavity, wherein a dimension of the projecting portion adjacent to the main portion is equal to a dimension of the main portion adjacent to the projecting portion and the dimension of the projecting portion increases in the span-wise direction away from the main portion to the distal end of the sheath, the projecting portion being configured to protect an area of the airfoil proximate to a root of the airfoil, the area of the airfoil extending axially forward from the root, the main portion having a substantially uniform dimension, measured from the outer edge of the solid member to a flank edge of the pressure side flank, and extending from the projecting portion to an opposite distal end of the sheath in the span-wise direction.

2. The sheath of claim 1, wherein the variable dimension of the projecting portion, as measured from the outer edge of the solid member to the flank edge of the pressure side flank, varies in dimension taken along the span-wise direction.

3. The sheath of claim 1, wherein the pressure side flank includes a dimension which covers a minimum section of a pressure surface side of the airfoil.

4. The sheath of claim 1, wherein the suction side flank includes a dimension which covers a minimum section of a suction surface side of the airfoil.

5. The sheath of claim 1, wherein the pressure side flank includes a dimension that is greater than a dimension of the suction side flank.

6. An airfoil for a gas turbine engine, the airfoil comprising:

a leading edge;

a pressure surface side;

a suction surface side; and a sheath including a solid member, a pressure side flank and a suction side flank, the solid member forming an outer edge, the outer edge including a main portion and a projecting portion, the projecting portion having a variable dimension and extending from the main portion to a distal end of the sheath in a span-wise direction, the pressure side flank projecting from the solid member opposite the outer edge, the suction side flank projecting from the solid member opposite the outer edge, the pressure side flank and the suction side flank forming a receiving cavity for receiving the leading edge, the pressure side flank secured to the pressure surface side, the suction side flank secured to the suction surface side, wherein a dimension of the projecting portion adjacent to the main portion is equal to a dimension of the main portion adjacent to the projecting portion and the dimension of the projecting portion increases in the span-wise direction away from the main portion to the distal end of the sheath, the projecting portion being configured to protect an area of the airfoil proximate to a root of the airfoil, the area of the airfoil extending axially forward from the root, the main portion having a substantially uniform dimension, measured from the outer edge of the solid member to a flank edge of the pressure side flank, and extending from the projecting portion to an opposite distal end of the sheath in the span-wise direction.

7. The airfoil as claimed in claim 6, wherein the variable dimension of the projecting portion, as measured from the outer edge of the solid member to the flank edge of the pressure side flank, varies in dimension taken along the span-wise direction of the airfoil.

8. The airfoil as claimed in claim 6, wherein the pressure side flank includes a dimension which covers a minimum section of the pressure surface side of the airfoil.

9. The airfoil as claimed in claim 6, wherein the suction side flank includes a dimension which covers a minimum section of the suction surface side of the airfoil.

10. The airfoil as claimed in claim 6, wherein the pressure side flank is secured to the pressure surface side by an epoxy adhesive and the suction side flank is secured to the suction surface side by an epoxy adhesive.

11. The airfoil as claimed in claim 6, wherein the airfoil is manufactured from aluminum.

12. The airfoil as claimed in claim 6, wherein the sheath is manufactured from titanium.

13. The airfoil of claim 6, wherein the pressure side flank includes a dimension that is greater than a dimension of the suction side flank.

14. A method of protecting a leading edge of an airfoil, comprising:

forming a sheath to include a solid member having an outer edge with a projecting portion and a main portion, a pressure side flank, and a suction side flank, the projecting portion adjacent to the main portion, the projecting portion having a variable dimension and extending from the main portion to a distal end of the sheath in a span-wise direction;

securing the sheath to the airfoil having a tip, a root, a pressure surface side, a suction surface side, and a trailing edge, the pressure side flank secured to the pressure surface side of the airfoil and the suction side flank secured to the suction surface side of the airfoil; and wherein a dimension of the projecting portion adjacent to the main portion is equal to a dimension of the main portion adjacent to the projecting portion and the dimension of the projecting portion increases in the span-wise direction away from the main portion to the distal end of the sheath, the projecting portion being configured to protect an area of the airfoil proximate to a root of the airfoil, the area of the airfoil extending axially forward from the root, the main portion having a substantially uniform dimension, measured from the outer edge of the solid member to a flank edge of the pressure side flank, and extending from the projecting portion to an opposite distal end of the sheath in the span-wise direction.

15. The method of claim 14, wherein forming the sheath includes forming the pressure side flank so that a dimension of the pressure side flank covers a minimum section of the pressure surface side of the airfoil.

16. The method of claim 14, wherein forming the sheath includes forming the suction side flank so that a dimension of the suction side flank covers a minimum section of the suction surface side of the airfoil.

17. The method of claim 14, wherein the pressure side flank includes a dimension that is greater than a dimension of the suction side flank.

* * * * *